US005226247A

United States Patent [19]

Ambrose

[11] Patent Number: 5,226,247

[45] Date of Patent: Jul. 13, 1993

[54] ADJUSTABLE FOOT SUPPORTED LIFTS

[76] Inventor: Frank Ambrose, 5805 Washington St., Apt. 17, Hollywood, Fla. 33023

[21] Appl. No.: 673,934

[22] Filed: Mar. 22, 1991

Related U.S. Application Data

[63] Continuation-in-part of Ser. No. 223,632, Jul. 25, 1988, abandoned.

[51] Int. Cl.[5] ..... A43B 19/00; A61F 5/14

[52] U.S. Cl. ..... 36/140; 36/88; 36/44; 36/103; 36/71; 36/182; 36/30 R

[58] Field of Search ..... 36/88, 91, 93, 43, 44, 36/103, 32 R, 71, 140, 145, 154, 169, 178, 148, 166, 172, 174, 176, , 180–182

[56] References Cited

U.S. PATENT DOCUMENTS

| | | | |
|---|---|---|---|
| 492,994 | 3/1893 | Sawyer | 36/145 X |
| 1,163,395 | 12/1915 | Cushman | 36/176 |
| 1,515,271 | 11/1924 | Platti | 36/176 |
| 1,565,266 | 12/1925 | Flanagan | 36/176 |
| 1,636,044 | 7/1927 | Connelly | 36/145 |
| 1,694,353 | 12/1928 | Messler | 36/176 |
| 1,832,659 | 11/1931 | Riley | 36/176 |
| 1,855,234 | 4/1932 | Hasel | 36/145 |
| 2,020,395 | 11/1935 | Bilbrey et al. | 36/145 |
| 2,134,598 | 10/1938 | Burns | 36/145 X |
| 2,159,054 | 5/1939 | Silver | 36/145 |
| 2,224,458 | 12/1940 | Levitt | 36/148 |
| 2,262,680 | 11/1941 | Hosker | 36/30 R X |
| 2,546,827 | 3/1951 | Lavinthal | 128/595 |
| 2,603,891 | 7/1952 | Cohn | 36/30 R X |
| 2,862,313 | 12/1958 | Jones | 36/145 |
| 2,884,717 | 5/1959 | Goldberg | 36/30 R X |
| 3,170,248 | 2/1965 | Levine | 36/148 X |
| 3,470,880 | 10/1969 | Pagliano | 36/178 |
| 4,133,118 | 1/1979 | Khalsa et al. | 36/44 X |
| 4,372,059 | 2/1983 | Ambrose | 36/30 R X |
| 4,631,841 | 12/1986 | Hickey | 36/145 X |
| 4,689,898 | 9/1987 | Fahey | 36/145 X |
| 4,739,765 | 4/1988 | Sydor et al. | 36/174 |
| 4,757,620 | 7/1988 | Tiitola | 36/30 R X |

FOREIGN PATENT DOCUMENTS

| | | | |
|---|---|---|---|
| 0204224 | 4/1939 | Switzerland | 36/112 |
| 0272329 | 6/1927 | United Kingdom | 36/106.3 |

*Primary Examiner*—Steven N. Meyers
*Assistant Examiner*—Ted Kavanaugh
*Attorney, Agent, or Firm*—Robert W. Fletcher; Jon C. Winger

[57] ABSTRACT

An electrical insole or outsole is provided to increase foot support. The insole is attached to the top of the sole body, whereas the outsole is attached to the bottom of the sole body. The insole or outsole has a raised front portion to shift some weight rearward to the center of the foot. The back portion of the insole is either raised or lowered, depending on the shoe heel height, to shift some weight forward to the center of the foot.

4 Claims, 3 Drawing Sheets

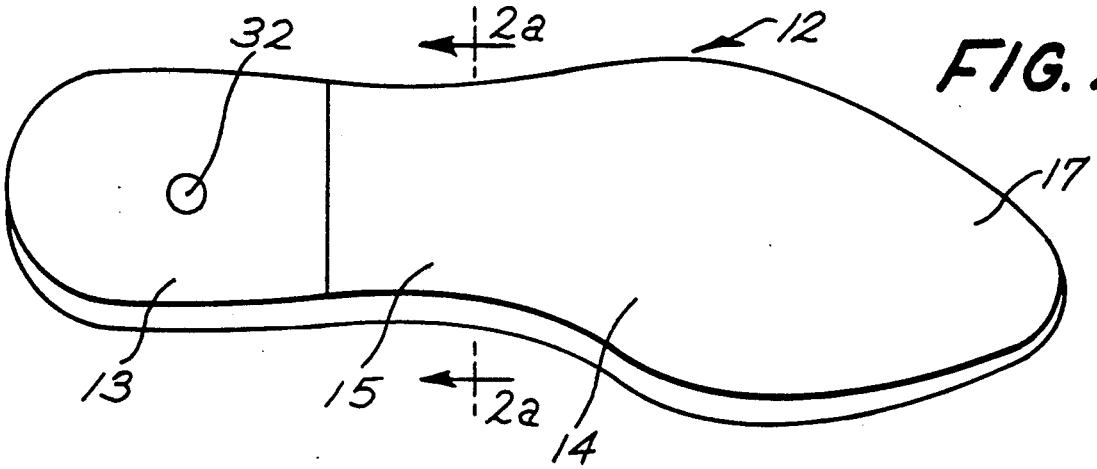
FIG. 2
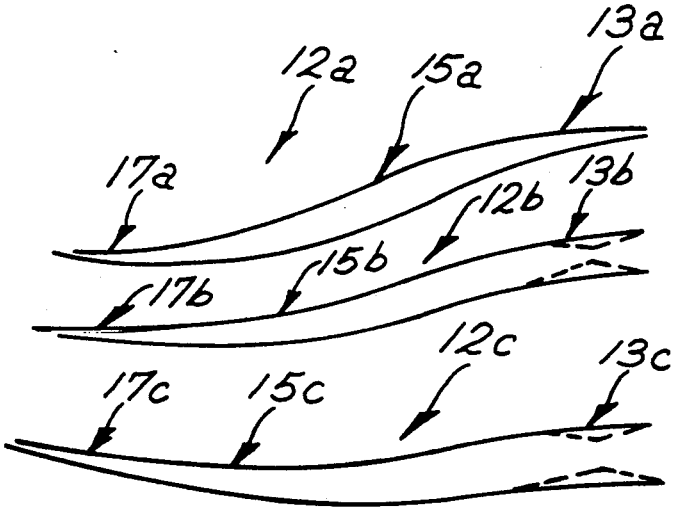
FIG. 3a
FIG. 3c
FIG. 3b
FIG. 4
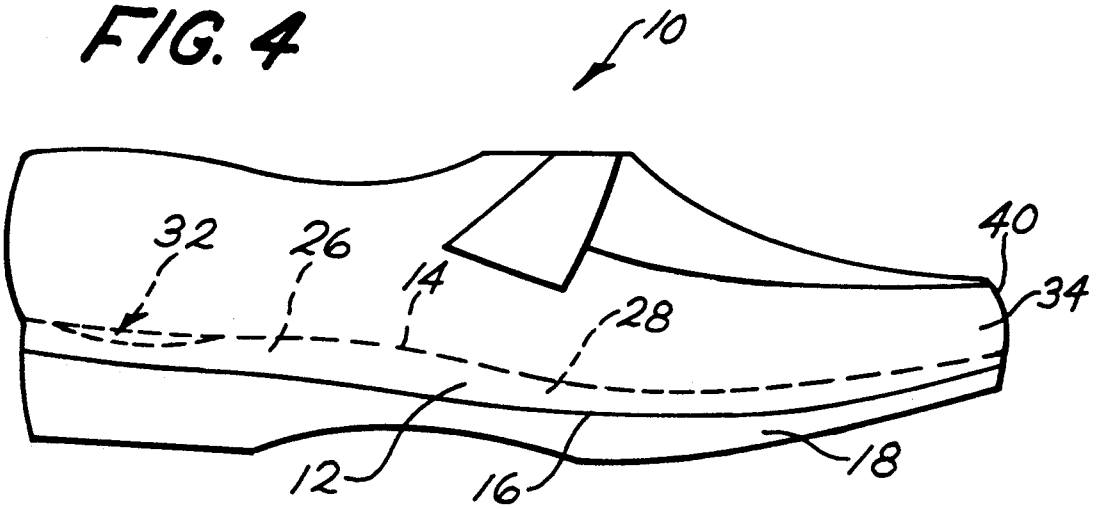

ADJUSTABLE FOOT SUPPORTED LIFTS

This application is a continuation-in-part of application Ser. No. 223,632, filed Jul. 25, 1988 now abandoned.

BACKGROUND OF THE INVENTION

1. Field of the Invention

The present invention generally relates to foot supports and, more particularly, is concerned with an elliptical insole or outsole for increasing the distribution of weight.

2. Description of the Prior Art

Adequate support in ones footwear is essential to a vast majority of today's population. Unnecessary injury to one's body can be considerably costly both financially as well as physically. Though most of today's footwear provides some support, usually these shoes fall well short of the support required to adequately reduce the chance of injury caused by lack of sufficient foot support.

Prior attempts to increase the support in one's footwear include U.S. Pat. No. 2,546,827, issued to Lavinthal. The Lavinthal patent teaches of an arch support which presents a permanently deformable and elastic surface for support of the wearer's foot. The Lavinthal arch support member can be inserted into the shoe or alternatively can be permanently attached inside the shoe. U.S. Pat. No. 3,470,880, issued to Pagliano, teaches of a pad which is positionable with respect to the foot and with respect to the shank portion of the shoe so that it provides an anchor for the heel or the foot and raises the transverse middle portion of the foot. U.S. Pat. No. 2,884,717, issued to Goldberg, teaches of an orthopedic shoe with an interformable platform Which over time experiences a permanent change of shape due to the pressure of the wearer's foot. British Pat. No. 272,329, issued to Knipe, teaches of a new or improved arch support for flat feet.

SUMMARY OF THE INVENTION

It is an object of the invention to provide an elliptical insole or outsole either alone or in combination which builds up support at the metatarsal and calcaneus to conform to the shape of the foot.

It is another object of the invention to provide an elliptical insole or outsole either alone or in combination which shifts some weight to the center of the foot.

It is still another object of the invention to provide an elliptical insole or outsole either alone or in combination which will reduce injuries caused by lack of adequate foot support.

It is yet another object of the invention to provide an elliptical insole or outsole either alone or in combination which is relatively inexpensive in cost.

These and other objects, that are apparent from the detailed description of the invention which follows, are accomplished by an elliptical foot support having a top and bottom surface. The foot support can be attached either to the top or bottom of the shoe sole body. When attached to the top, the foot support encompasses the entire length of the shoe. The top surface of the foot support will be made of a firm material and will direct the foot in order to adjust the plane of the foot. The front portion of the foot support will be raised in order to shift some of the wearer's weight to the center of the foot. Depending on the height of the shoe heel, the back portion will either raise or lower the heel to distribute weight to the center of the foot. Thus, instead of the metatarsal and calcaneal areas receiving most of the pressure as in a normal shoe, with use of the present invention a majority of the foot will be utilized in supporting the weight. This will greatly reduce the pressure and associated problems due to such pressure on the metatarsal and calcaneal areas.

When the foot support is attached to the bottom of the shoe sole body, the firm bottom surface will direct the shoe in order to adjust the plane of the foot and thereby shift some of the weight towards the center area between the metatarsal and calcaneal areas of the foot. Additionally, two foot supports can be used at one time. First foot support can be attached to the top of the shoe sole body while the second foot support will be attached to the bottom. Any suitable fastening means can be utilized in attaching the foot supports. Additionally, the insole foot support can either be permanently attached in the shoe or can be removable.

Other objects and advantages of the invention will become apparent from the consideration of the following detailed description taken in connection with the accompanying drawings wherein certain methods and installations for practicing the invention are illustrated. However, it is to be understood that the invention is not limited to the details disclosed but includes all such variations and modifications as fall within the spirit of the invention and the scope of the appended claims.

BRIEF DESCRIPTION OF THE DRAWINGS

The drawings illustrate embodiments which are presently preferred, it being understood, however, that the invention is not limited to the precise arrangements and instrumentality shown.

FIG. 2 is a perspective view of one embodiment of the present invention.

FIG. 3A is a side view of one embodiment according to the principles of the present invention.

FIG. 3B is a side view of another embodiment according to the principles of the present invention.

FIG. 3C is a side view of another embodiment according to the principles of the present invention.

FIG. 4 is a perspective view of a shoe containing one embodiment according to the principles of the present invention.

DETAILED DESCRIPTION OF THE PREFERRED EMBODIMENT

Figure 1:
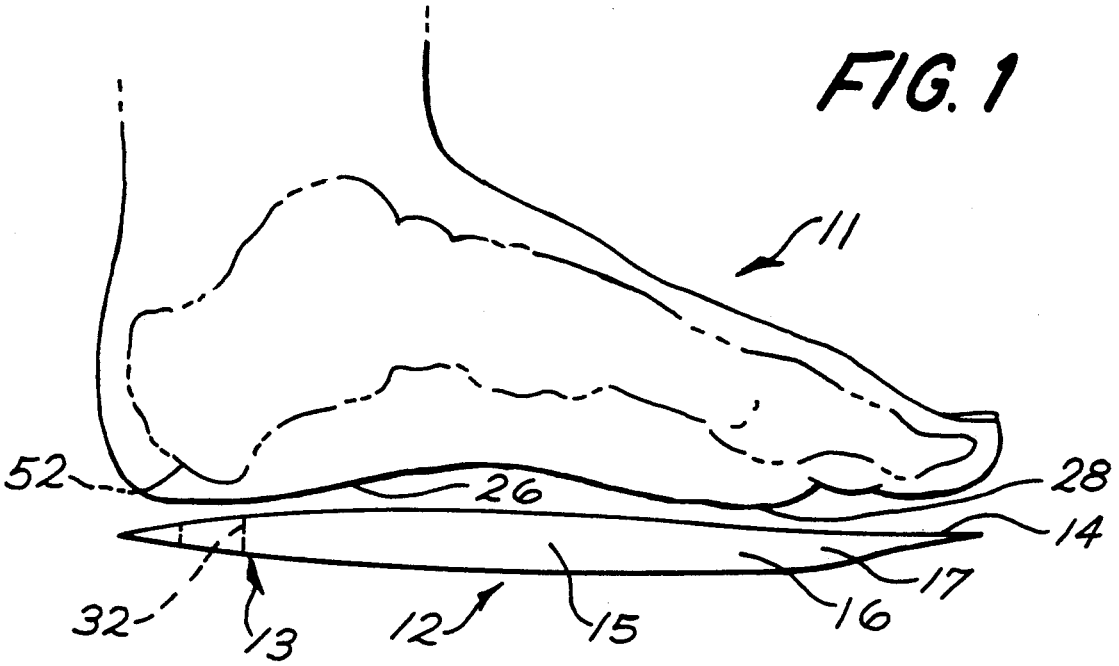
FIG. 1 is a perspective view of a human foot showing the bones of the foot in relation to their location of one embodiment according to the principles of the present invention.
Figure 1A:
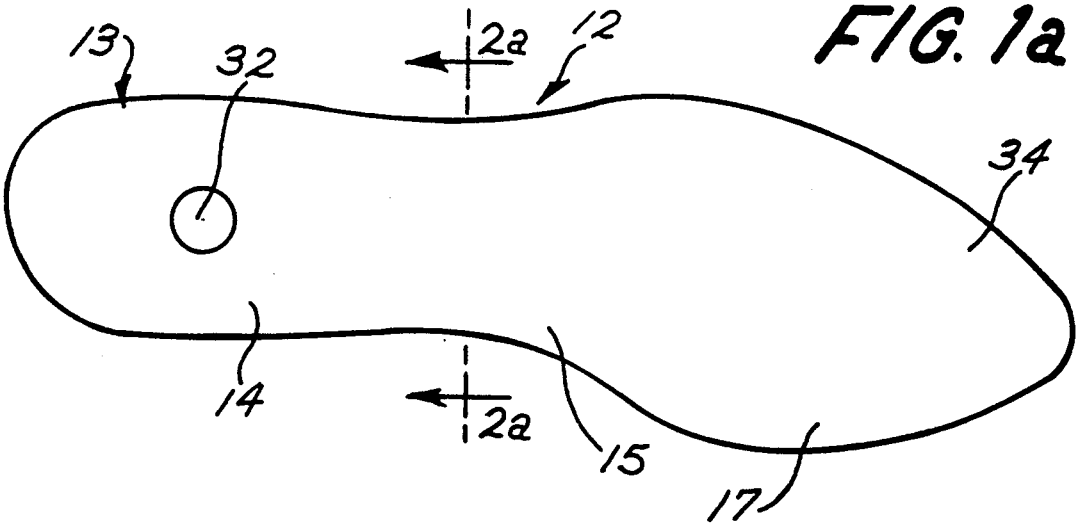
FIG. 1A is a top view of one embodiment of the present invention.

Referring now to the drawings, as seen in FIGS. 1 and 1A an elliptical insole 12 is shown having a top surface 14 and a bottom surface 16. In addition, insole 12 has a back portion 13, middle portion 15 and front portion 17. Back portion 13 will merge smoothly with one end of middle portion 15. Front portion 17 will merge smoothly with the other end of middle portion 15. Also seen in FIG. 1, middle portion 15 will be relatively thicker than back portion 15 and front portion 17. In addition, back portion 13 and front portion 17 both decrease in thickness in relation to the closer top surface 14 and bottom surface 16 are becoming joined at the respective rear and front ends. The center area 32 of back portion 13 will be made of a less dense material than the rest of insole 12. Thus, when the wearer inserts his foot 11 into a shoe 10 having an insole 12 attached to the top of the sole of the shoe 10, heel bone 52 will make an indentation in center area 32 and will comfortably rest in center area 32. By resting in center area 32, foot 11 will be centered on the adjacent insole 12. Once centered, insole 12 stabilizes and cushions foot 11 upon initial contact with the ground.

Insole 12 will build up support at the calcaneal 26 and at the metatarsal 28 areas of foot 11. In addition, insole 12 will shift some of the shoe wearer's weight to the center of the foot 11 and thus relieves pressure on the heel and ball of foot 11. By raising or lowering the plane of the foot 11, insole 12 engages the middle portion of foot 11. Thus, weight is distributed to the center portion of foot 11. Therefore, the entire foot is brought into the sequence of motion, eliminating the void ellipse influx, as much as possible.

FIGS. 3A, 3B and 3C illustrate a variety of insoles **12*a*, 12*b* and 12*c*. The different slopes of middle portion 15*a*, 15*b*, 15*c* are dictated by the height of the heel 30 of shoe 10. Mid-portion 15*a*, having the greatest slope, would be utilized in conjunction with a high heeled shoe. Mid-portion 15*b* would be utilized in conjunction with a medium height heel and mid-portion 15*c* would be utilized with low or flat heeled shoes. It is to be understood that these three slopes are not determinative of the mid-portion 15 slope and that any mid-section slope as dictated by the corresponding shoe heel height can be utilized. Insoles 12*a*, 12*b* and 12*c* all have a raised front portion 17. By raising front portion 17 the plane of the foot is adjusted to shift some of the wearer's weight to the middle portion 15**.

Also from FIG. 3, back portion **13*a*, 13*b* and 13*c* are shown each having a different vertical thickness. Insole 12*a* is used with high-heeled shoes and requires the least amount of thickness for its back portion 13*a*. By having a thin back portion 13*a*, the raised front portion 17*a* and a large slope for its mid-portion shank 15*a*, insole 12*a* when inserted in the high-heeled shoe will lower the heel of foot 11 relatively. By lowering the heel physically, the plane of the shoe 10 will be lowered and the ball of the foot will be raised relatively. With low or flat heeled shoes, the plane of the shoe is too low to provide a sufficient shock absorbing effect. Insole 12*c* is used with low or flat heels and requires the greatest amount of thickness for its back portion 13*c* to provide a shank engaging rebound/shock effect. By having a thick back portion 13*c*, a raised front portion 17*c* and a minimal amount of slope for its mid-portion 15*c*, insole 12*c* when inserted in a low or flat heeled shoe will raise the heel of foot 11. By raising the heel physically, the plane of foot 11 will be raised and the ball of the foot will be lowered relatively. Accordingly, insole 12*b* will effect the plane of foot 11 somewhere inbetween the effect caused by insoles 12*a* and 12*c***.

The adjustment of the plane of foot 11 will cause some of the wearer's weight to be transferred to the center portion of foot 11 regardless of the type of shoe or height of the heel. Instead of the normal two points of support (metatarsal area 28 and calcaneal area 26), the foot is in contact with a third area of the shoe (mid section shank 15) and is supported by a larger area of the foot. Accordingly the pressure on the metatarsal area 28 and calcaneal area 26 of foot 11 is greatly reduced. Thus, problems associated with foot supports are postponed if not eliminated.

Figure 5:
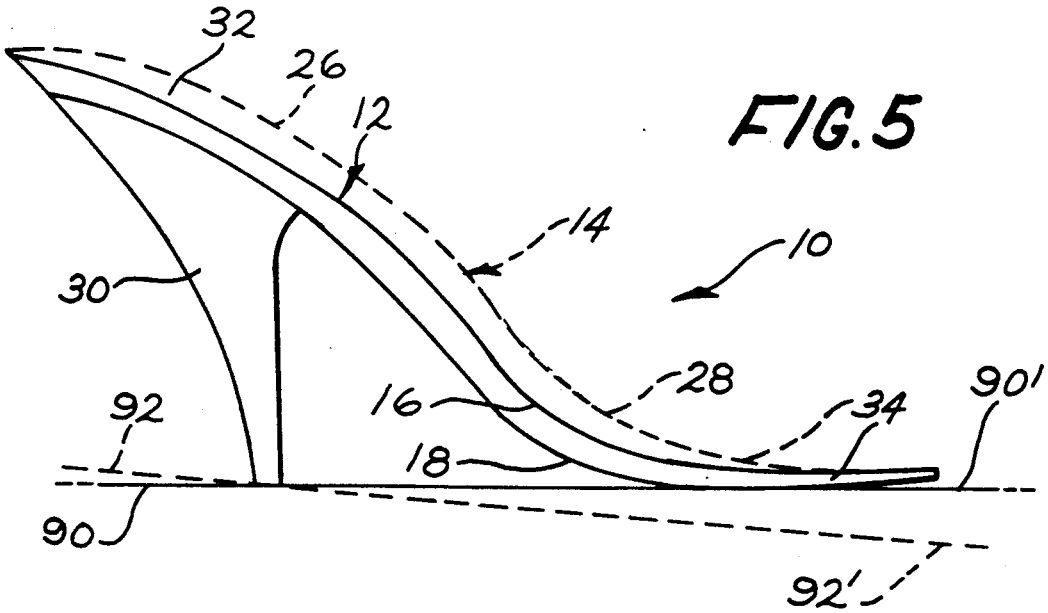
FIG. 5 is a perspective view of a high heeled shoe containing one embodiment according to the principles of the present invention.

As shown in FIG. 5, one embodiment of the present invention is shown attached to a high heeled shoe. An elliptical insole 12 having a top layer 14 and bottom layer 16 is shown attached to a shoe 10. The length of insole 12 is the entire shoe 10. Insole 12 helps to support the shoe wearer's foot 11 by shifting some of the wearer's weight to the middle of the foot between the metatarsal area 28 and the calcaneal area 26. In a stationary upright position from front to back, insole 12 tapers upward, at an angle dependent on the height of the heel 30, to the metatarsal area 28, raises the ball of the foot and thus adjusts the plane of the foot by transferring weight gently rearward between the metatarsal area 28 and calcaneal area 26. Accordingly, support is also provided at the area between metatarsal area 28 and calcaneal area 26, a larger area of the wearer's foot for a longer period of time, and thus, relieves pressure at the normal areas of foot support 26 and 28. Insole 12 is concave from point 28 extending to the back of insole 12. Thus back to front the ellipse rises to meet the apex of the navicular, cuneiform, cuboid, talus area at point 26 on the way to the metatarsal area 28. Wherein, insole 12 presents a declining longitudinal convex section past metatarsal area 28 to the toe area 34. Thus, insole 12, along with the aid of the existing sole body 18, presents support for the entire foot.

Figure 2A:
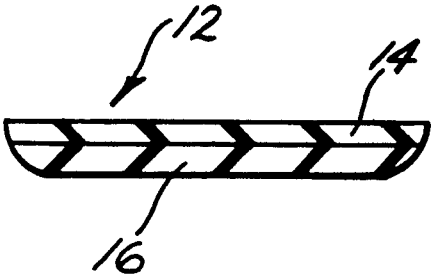
FIG. 2A is a cross sectional view of FIG. 2 taken along the lines 2A.

As shown in FIG. 2, insole 12 is planar before use and is not orthopedic with voids or contours, cosmetic contours excepted. The top layer 14 is made of a firm material in order to direct the foot 11. The top layer 14 can be constructed of leather or vinyl backed with fabric or fiber. Although leather is the preferred material for the top layer 14 of insole 12 for the instant invention, any other material which is firm and able to direct the foot 11 is within the scope of the invention. Bottom layer 16 can be of an entirely deformable, flexible and resilient material. Preferably, bottom layer 16 is a combination of a layer of closed cell and a layer of open-celled layer, vinyl or sponge. These examples for the top layer 14 and bottom layer 16 are merely exemplary and are not intended to be limiting. The important thing is that the top layer 14 is of a firm material in order to direct the foot 11. As shown in FIG. 2A, the thickness is constant laterally and across the width of insole 12 and, therefore, there is no horizontal influence on foot 11. By having a firm top layer 14, insole 12 caters to the bones of the foot instead of the shape of the foot as do orthotic supports.

Though FIG. 5 shows the insole attached to a high-heeled shoe 10, as seen in FIG. 4, insole 12 can be used in conjunction with any type of shoe 10. When used in conjunction with the type of shoe 10 shown in FIG. 4, insole 12 can be permanently inserted prior to placing sole body 18 and shoe upper 40 together or insole 12 can be removable. In a preferred embodiment, insole 12 is removable. When using insole 12 with a shoe 10 containing a shoe upper 40, an adjusted allowance for foot access in the shoe 10 will have to be provided. Therefore, in the construction of shoe 10 having a shoe upper 40, the shoe last will have to accommodate for the insertion of insole 12 as well as foot 11.

In operation, a portion of insole 12, beginning with the front end 34 of insole 12 extending rearward, raises the adjacent area of foot 11 past point 28 to transfer some of the wearer's weight to the center of the foot. Then, depending on the heel height, a portion of insole 12, beginning with calcaneal area 26 and extending backwards to the back end of insole 12 will either raise or lower the back of the foot. In conjunction with, high-heeled shoes, the back of the foot will be lowered in order to shift the weight of the wearer to the center of the foot. Whereas, with lower substantially or flat heel shoes, the back of the foot will be raised. In addition, with low or no heel shoes, the foot is deprived of the shank engaging rebound effect associated with walking in high or medium heel shoes. Insole 12 when used in conjunction with the low or no heel shoe will supply this shank engaging rebound effect associated with high or medium heeled shoes. Insole 12 adjusts the plane of the foot to help create an ellipse influx and fills the void usually created between areas 26 and 28 to provide support not only at areas 26 and 28 but also at the area between areas 26 and 28.

Figure 6:
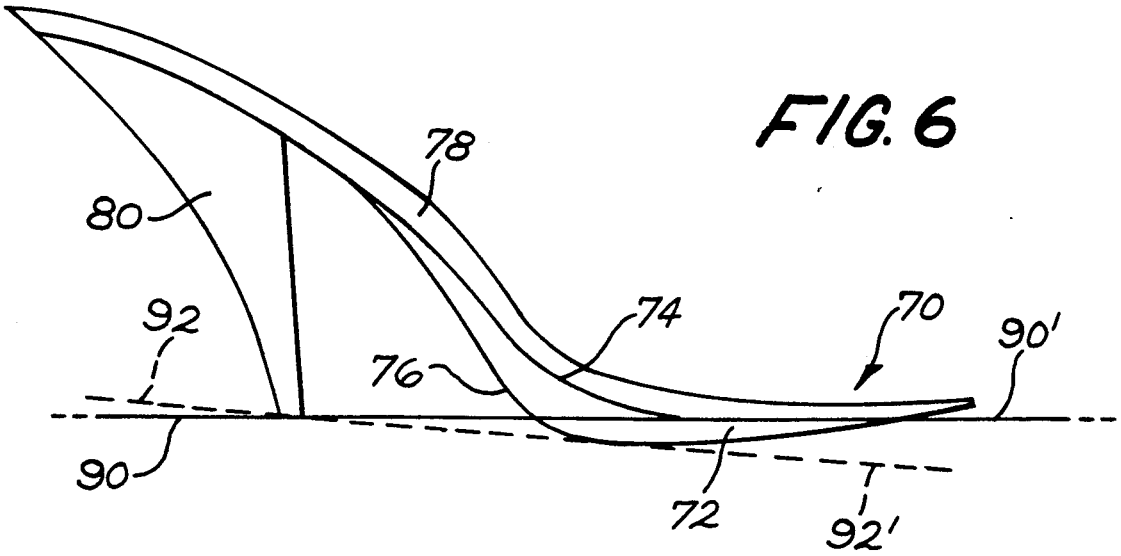
FIG. 6 is a high heeled shoe containing another embodiment according to the principles of the present invention.

Another embodiment of the present invention is shown in FIG. 6, where an elliptical outsole 72, having a top layer 74 and bottom layer 76, is attached to the bottom of the sole body 78. Top layer 74 can be constricted of an entirely deformable, flexible and resilient material as bottom layer 16 of insole 12. Similarly, bottom layer 76 will be constructed of the same firm material as top layer 14 of insole 12. As seen in FIG. 6 by attaching outsole 72 to sole bottom 78, shoe plane 90—90' is adjusted to new shoe plane 92—92', causing the wearer's weight tc be distributed over a greater area of the foot, similar to the weight distribution created by insole 12. When line 92—92' is brought up to the ground level 90—90', the front of shoe 10 is higher than before attaching sole body 72. Outsole 72 physically raises the ball of foot 11 which lowers the heel relatively. Outsole 72 extends from the heel forward to the front of shoe 70. Outsole 72 is of a convex shape with its lowest portion adjacent to the ball of foot 11. Bottom layer 76 directs the shoe in a similar fashion as top layer 14 of insole 12.

Figure 6A:
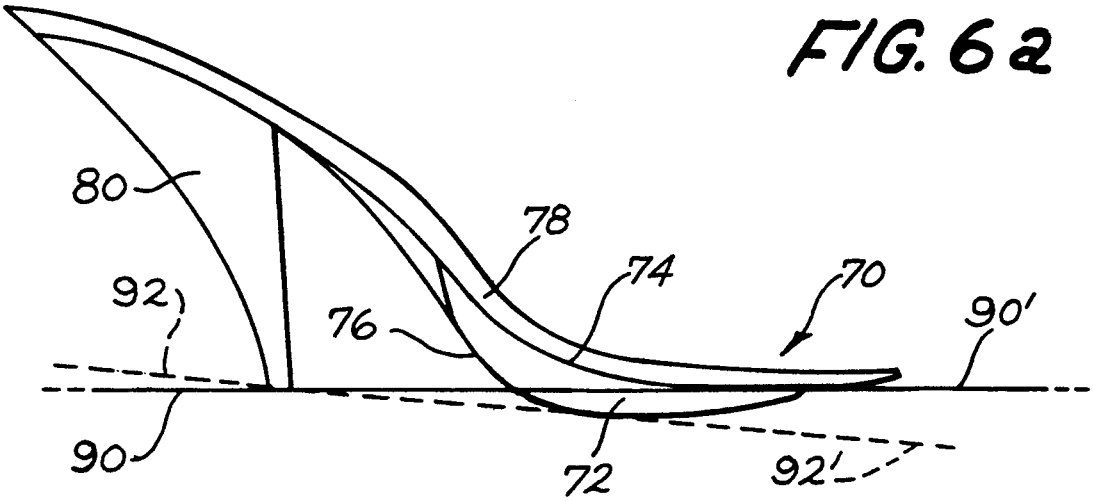
FIG. 6A is a perspective view of a high heeled shoe containing another embodiment according to the principles of the present invention.

A variation of outsole 72 is shown in FIG. 6A, where the front toe portion of outsole 72 in FIG. 6 is removed. Since outsole 72 of FIG. 6 extends to the front end of shoe 70, the design of outsole 72 will have to correspond to the toe design of shoe 70 and will not be of a standard shape. These various designs of outsole 72 will cause the manufacturer's costs to increase. By removing a slight front toe portion of outsole 72 as in FIG. 6A, a standard shape for outsole 72 can be used for any toe styled shoe. Thus, manufacturing costs will be greatly reduced. Outsole 72 of FIG. 6A distributes the wearer's weight in the same fashion as outsole 72 of FIG. 6 and constitutes another embodiment of the invention.

The last and preferred embodiment of the present invention attaches the insole 12 and outsole 72 described above simultaneously to the top and bottom of the sole body 18 to place the foot 11 in a contoured position and thus providing support at a larger area of foot 11.

While the instant invention has been described in what is considered to be the preferred embodiment, as well is alternative embodiments, it is to be understood that these descriptions are given by means of example only, and not by means of limitation. It is to be understood that changes and modifications may be made to the description given and still be within the scope of the invention. Further, it is clear that obvious changes and modifications will occur to those skilled in the art.

I claim:

1. A foot support attached to a shoe sole body for shifting some weight to the center of the foot, comprising:

an outsole, having a top and bottom layer, said outsole having a front, middle and back portion, the middle portion being thicker than the back and front portions, said bottom layer being of a firm material relative to the top layer, wherein said top layer is made of a relatively deformable material, and the thickness of the outsole is substantially constant laterally across the width of the outsole; wherein said outsole is attached to the bottom of said shoe sole body wherein said front portion is raised to shift some weight rearward to said center of the foot and wherein said front portion terminates short of the front toe end of the shoe sole body.

2. The foot support of claim 1, wherein the center area of the back portion is fabricated of a less dense material than the rest of the insole.

3. A foot support attached to a shoe sole body for shifting some weight to the center of the foot, comprising:

a. an insole, having a top and bottom layer, said insole having a front, middle and back insole portion, the middle portion being thicker than the back and front portions, said top insole layer being of a firm material relative to the bottom layer, and said bottom insole layer being made of a relatively deformable material the insole being substantially as long as the shoe sole body, and the thickness of the insole is substantially constant laterally across the width of the insole; and b. an outsole, having a top and bottom layer, said outsole having a front, middle and bottom outsole portion, the middle portion being thicker than the back and front portions, said bottom outsole layer terminating short of the front toe end of the shoe sole body and being of a firm material relative to said top layer, and the thickness of the outsole being substantially constant laterally across the width of the outsole; wherein said insole is attached to the top of said shoe sole body and said outsole is attached to the bottom of said shoe sole body.

4. The foot support of claim 3, wherein the center area of the back portion of the insole is fabricated of a less dense material than the rest of the insole.

* * * * *